US006964511B2

(12) United States Patent
Rumph

(10) Patent No.: US 6,964,511 B2
(45) Date of Patent: Nov. 15, 2005

(54) MIXING APPARATUS AND METHOD

(75) Inventor: Robert M. Rumph, Sumter, SC (US)

(73) Assignee: The Maitland Company, Sumter, SC (US)

( * ) Notice: Subject to any disclaimer, the term of this patent is extended or adjusted under 35 U.S.C. 154(b) by 0 days.

(21) Appl. No.: 10/302,871

(22) Filed: Nov. 25, 2002

(65) Prior Publication Data

US 2003/0156492 A1 Aug. 21, 2003

Related U.S. Application Data

(60) Provisional application No. 60/357,860, filed on Feb. 21, 2002.

(51) Int. Cl.[7] ..... B01F 5/12; B01F 7/06

(52) U.S. Cl. ..... 366/261; 366/270; 366/285; 366/308; 366/345

(58) Field of Search ..... 366/261, 285, 366/308, 286, 270, 345, 293

(56) References Cited

U.S. PATENT DOCUMENTS

| | | | | | |
|---|---|---|---|---|---|
| 1,447,653 | A | * | 3/1923 | Fish | 366/247 |
| 1,827,004 | A | * | 10/1931 | Gibson | 366/308 |
| 1,841,435 | A | * | 1/1932 | Gibson | 366/308 |
| 2,505,194 | A | * | 4/1950 | Loss | 406/47 |
| 2,711,306 | A | * | 6/1955 | Levi | 366/273 |
| 2,791,406 | A | * | 5/1957 | Bates | 366/270 |
| 2,859,020 | A | | 11/1958 | Eddy et al. | 366/274 |
| 2,965,364 | A | | 12/1960 | Parker et al. | 366/282 |
| 3,207,489 | A | * | 9/1965 | Berman | 366/308 |
| 3,367,583 | A | * | 2/1968 | Kellogg | 241/98 |
| 4,431,597 | A | * | 2/1984 | Cramer et al. | 261/93 |
| 4,441,824 | A | * | 4/1984 | Brokaw | 366/266 |
| 4,519,714 | A | * | 5/1985 | Johnson et al. | 366/285 |
| 4,594,006 | A | * | 6/1986 | Depeault | 366/266 |
| 4,836,687 | A | * | 6/1989 | Kardoes et al. | 366/286 |
| 5,282,681 | A | | 2/1994 | Supelak | 366/246 |
| 5,326,167 | A | * | 7/1994 | Ware et al. | 366/247 |
| 5,366,289 | A | | 11/1994 | Supelak | 366/308 |
| 6,276,825 | B2 | * | 8/2001 | Running et al. | 366/270 |
| 6,276,826 | B1 | | 8/2001 | Rumph | 366/270 |

* cited by examiner

*Primary Examiner*—Tony G. Soohoo
(74) *Attorney, Agent, or Firm*—Finnegan Henderson Farabow Garrett & Dunner, L.L.P.

(57) ABSTRACT

A mixing apparatus including a frame, a housing, and a pair of thrust generators are disclosed. The housing is pivotably mounted to the frame and is movable between a retracted position substantially parallel with the frame and an extended position substantially perpendicular to the frame. The thrust generators are opposingly mounted to the housing and face opposite directions both when the housing is in the retracted position and when the housing is in the extended position. Various mixing and disposal methods are also described.

19 Claims, 4 Drawing Sheets

MIXING APPARATUS AND METHOD

RELATED APPLICATIONS

This application claims the benefit of U.S. Provisional Patent Application No. 60/357,860, filed on Feb. 21, 2002, which is expressly incorporated herein by reference.

BACKGROUND OF THE INVENTION

This invention generally relates to a mixing apparatus and a related mixing method. More particularly, the present invention relates to a mixing apparatus for mixing liquid and solid constituents of a substance to a homogenous liquid/solids mixture and to a related method of mixing a substance including liquid and solid constituents.

Many industrial processes require raw materials in the form of solids and liquid mixtures that tend to separate into solids and liquid constituents when stored or transported. For example, mixtures, such as calcium carbonate in water or clay water slurries, are extremely difficult to transport and store because dense solid materials settle on the bottom of storage containers during transportation and/or storage. When the container is drained, the liquid portion of the mixture is readily removed, but a portion of the solid sediment remains in the storage container. Thus, it is difficult to completely unload all of the solid material.

Calcium carbonate exemplifies a substance used as a component in the manufacture of many common household and medical products from antacids to toothpaste. Additionally, the paper industry uses this material as a substitute for wood pulp paper filler to eliminate the need for unnecessary destruction of forestry. Calcium carbonate is a fine powder substance that is normally mixed with water to create a solid and liquid suspension that is relatively easy to handle for transport in railroad tank cars or tank trucks. Because of the great demand for the end products produced by these industries, extremely large quantities of calcium carbonate must be transported.

While the liquid/solids mixture is within the tank of a transportation or storage device, the solids settle in the liquid and gradually form sediment on the bottom of the tank. This solid sediment is extremely difficult to remove from the tank when the tank is unloaded. The retention of solids in the bottom of the tank poses numerous disadvantages. First, the solids/liquid ratio of the removed mixture is reduced by the retained solids. Secondly, the backhaul of a mobile tank to pick up another load requires unnecessary rehauling of the solids back to the original pickup point, making the tank heavier and wasting fuel. Additionally, the build-up of solids reduces the capacity of the tank so that each subsequent refill of the tank includes less and less volume. Therefore it is desirous to remove substantially all of the settled solid material along with the liquid when the mixture is unloaded. This removal process can be extremely time consuming and expensive.

By way of another example, the invention may be used in the waste industry for mixing solid and liquid constituents of waste products. The invention can be used for example, to blend organic waste having a BTU value (such as K-waste, paint waste, coal tar, or other burnable materials) before it is off-load and burned at an incinerator or cement kiln.

SUMMARY OF A FEW ASPECTS OF THE INVENTION

The advantages and purposes of the invention are set forth in part in the description which follows, and in part may be evident from the description, or may be learned by practice of the invention. The advantages and purposes of the invention may be realized and attained by the elements and combinations particularly pointed out in the appended claims.

In accordance with the invention, a mixing apparatus may include an elongated support structure, and a mixing unit pivotably mounted to the support structure for movement between a retracted position substantially parallel with the support structure and an extended position oriented angularly relative to the support structure, the mixing unit having a pair of opposingly operable thrust generators facing in opposite directions in all angular positions of the mixing unit.

In another aspect, the invention may be directed to a method for mixing liquid and solid constituents contained in a tank having a floor, with a pivotal mixing unit having a pair of opposing thrust generators. The method may include lowering the mixing unit into a tank with the thrust generators in a first position such that one of the thrust generators substantially faces the floor of the tank, clearing the settled solid constituents from an area of the floor of the tank, moving the thrust generators to a second position generally parallel to the floor of the tank at the area cleared of the settled solid constituents, and mixing the liquid and solid constituents of the substance, including the settled solid constituents, with the thrust generators in the second position.

Additional objects and advantages of the invention may be set forth in part in the description which follows, and in part may be evident from the description, or may be learned by practice of the invention. The objects and advantages of the invention may be realized and attained by means of the elements and combinations particularly pointed out in the appended claims.

It is to be understood that both the foregoing general description and the following detailed description are exemplary and explanatory only and are not restrictive of the invention, as claimed.

BRIEF DESCRIPTION OF THE DRAWINGS

The accompanying drawings, which are incorporated in and constitute a part of this specification, illustrate an embodiment of the invention and together with the description, serve to explain the principles of the invention. In the drawings.

DETAILED DESCRIPTION OF EXEMPLARY EMBODIMENTS

Reference will now be made in detail to the presently preferred embodiment of the present invention, an example of which is illustrated in the accompanying drawings. Wherever possible, the same reference numbers will be used throughout the drawings to refer to the same or like parts.

In accordance with the invention, there may be provided a mixing apparatus having an elongated support structure, and a mixing unit pivotably mounted to the support structure for movement between a retracted position substantially parallel with the support structure and an extended position oriented angularly relative to the support structure.

Figure 1:
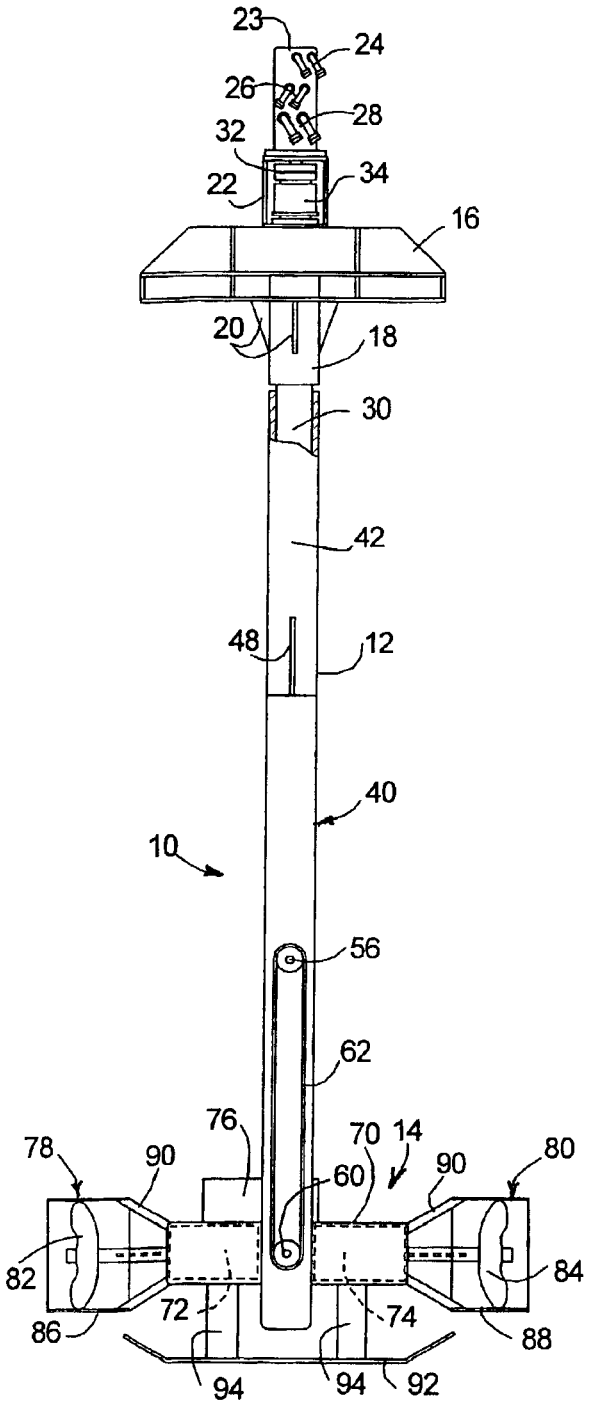
FIG. 1 is a front elevation of the mixing apparatus of an embodiment consistent with the present invention.
Figure 2:
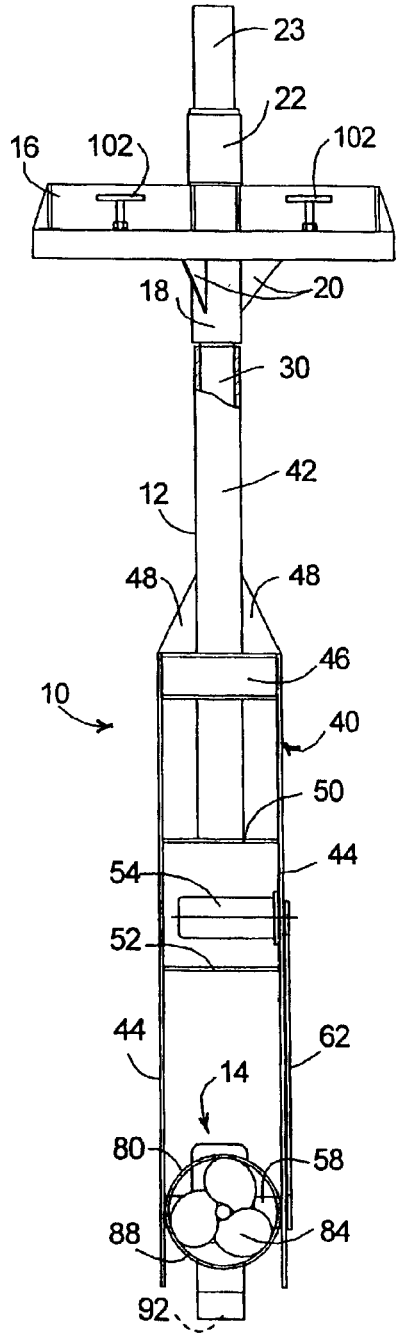
FIG. 2 is a side elevation of the mixing apparatus shown in FIG. 1.

As embodied herein and illustrated most clearly in FIGS. 1 and 2, one example of a mixing apparatus made in accordance with the invention is generally designated by the reference number 10 and may include an elongated support structure 12 and a mixing unit 14 pivotably mounted to the support structure 12. The support structure 12 may be carried in a vertical orientation by an handling pallet 16 having a depending bushing 18 secured by gusset plates 20 in alignment with an upstanding housing 22 and a hydraulic header 23 having hydraulic fluid fitting pairs 24, 26 and 28. A tubular shaft 30 may be journalled in the bushing 18 and may be supported against axial movement relative to the handling pallet 16 by a thrust bearing 32 in the housing 22. A motor 34 may also be contained in the housing 22 and may be operable by hydraulic fluid supplied to and exhausted from the fitting pair 24 to rotate the shaft 30. One example of a suitable motor is a Permco wheel gear motor, operated remotely by a Permco high displacement hydraulic pump. Of course, throughout this patent, the invention in its broadest sense is not necessarily limited to the structures or equipment described. Alternative structures, equipment and methods may be used without departing from the spirit of and scope of the invention.

A bifurcated unit frame 40 may be suspended from a stainless steel tube 42 secured to the shaft 30 against both rotational and axial movement by appropriate joining means (not shown). The unit frame 40 may include two spaced apart elongated plates 44 joined at their top ends, such as by welding, to a bracket 46 welded to the tube 42 and reinforced by welded gusset plates 48. The plates 44 may be joined to each other intermediate their length by transverse reinforcing plates 50 and 52 that may be located respectively above and below a hydraulic motor 54. Motor 54 may have an output pulley/sprocket 56 and to which hydraulic fluid is supplied and exhausted through conduits (not shown) connected to the hydraulic fitting pair 26. At their lower ends, the plates 44 may support pivotal bearings 58 associated with the mixing unit 14 to which a pulley/sprocket 60 is fixed. An endless belt/chain 62 may be trained about pulley/sprockets 56 and 60 on the outside of one of the plates 44 so that operation of the motor 54 may control pivotal movement of the mixing unit 14 relative to the frame 40.

Figure 3:
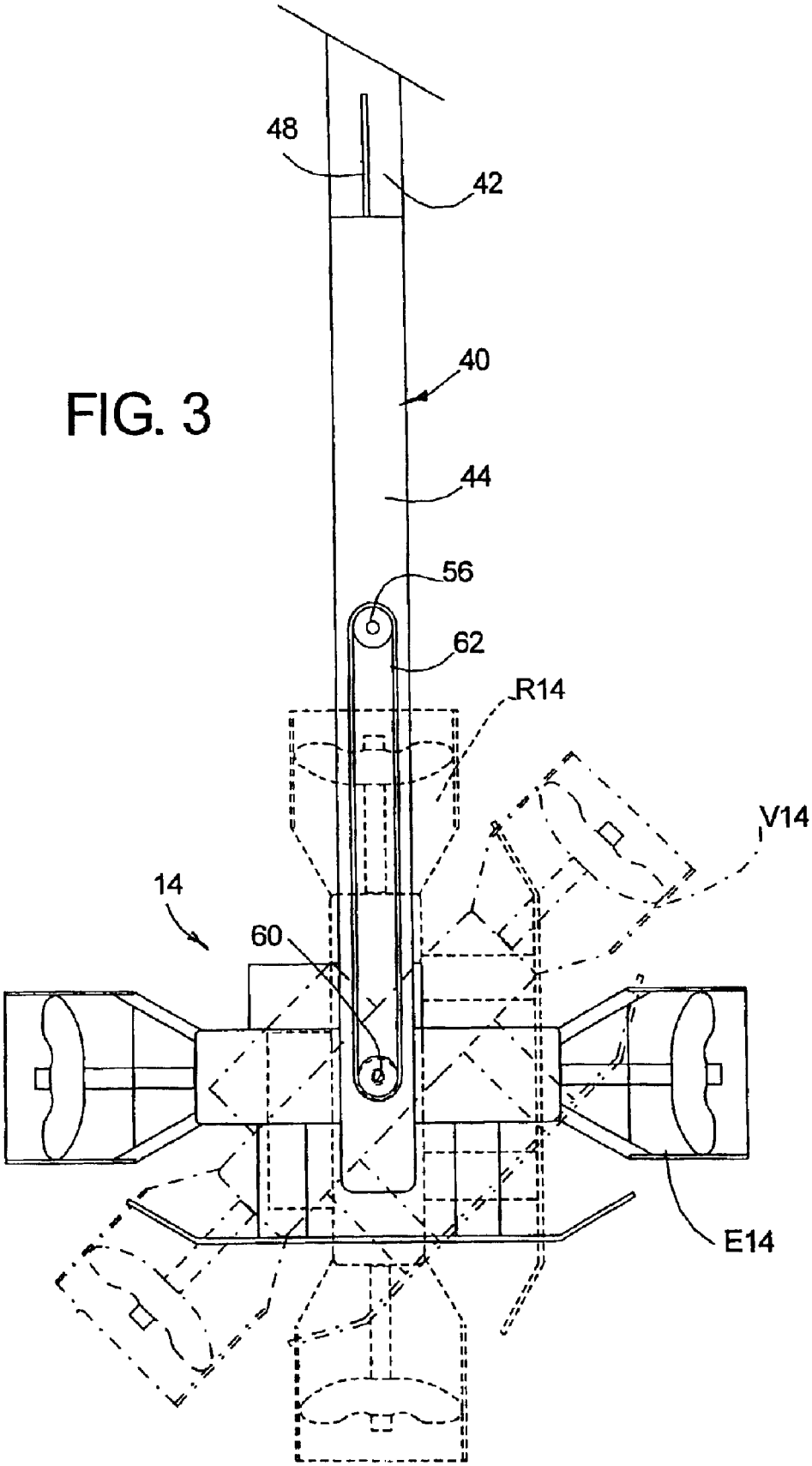
FIG. 3 is an enlarged fragmentary front elevation showing various operating positions of the mixing unit of an exemplary apparatus of the present invention.

In FIG. 3 of the drawings, various positions to which the mixing unit 14 may by moved by the motor 54 are shown to include an extended position E14 shown in solid lines and in which the mixing unit is oriented perpendicular to the frame 40; a retracted position R14 shown in dashed lines and in which the mixing unit 14 is aligned with the frame 40; and a variable intermediate position V14 shown in dot-dash lines and in which the mixing unit 14 is inclined relative to the frame 40. As will be described in more detail below, each of these positions, as well as other intermediate positions, may be used in operation of the mixing apparatus 10.

In accordance with the invention, the mixing unit may have a pair of opposingly operable thrust generators facing in opposite directions in all angular positions of the mixing unit.

Figures 5, 6:
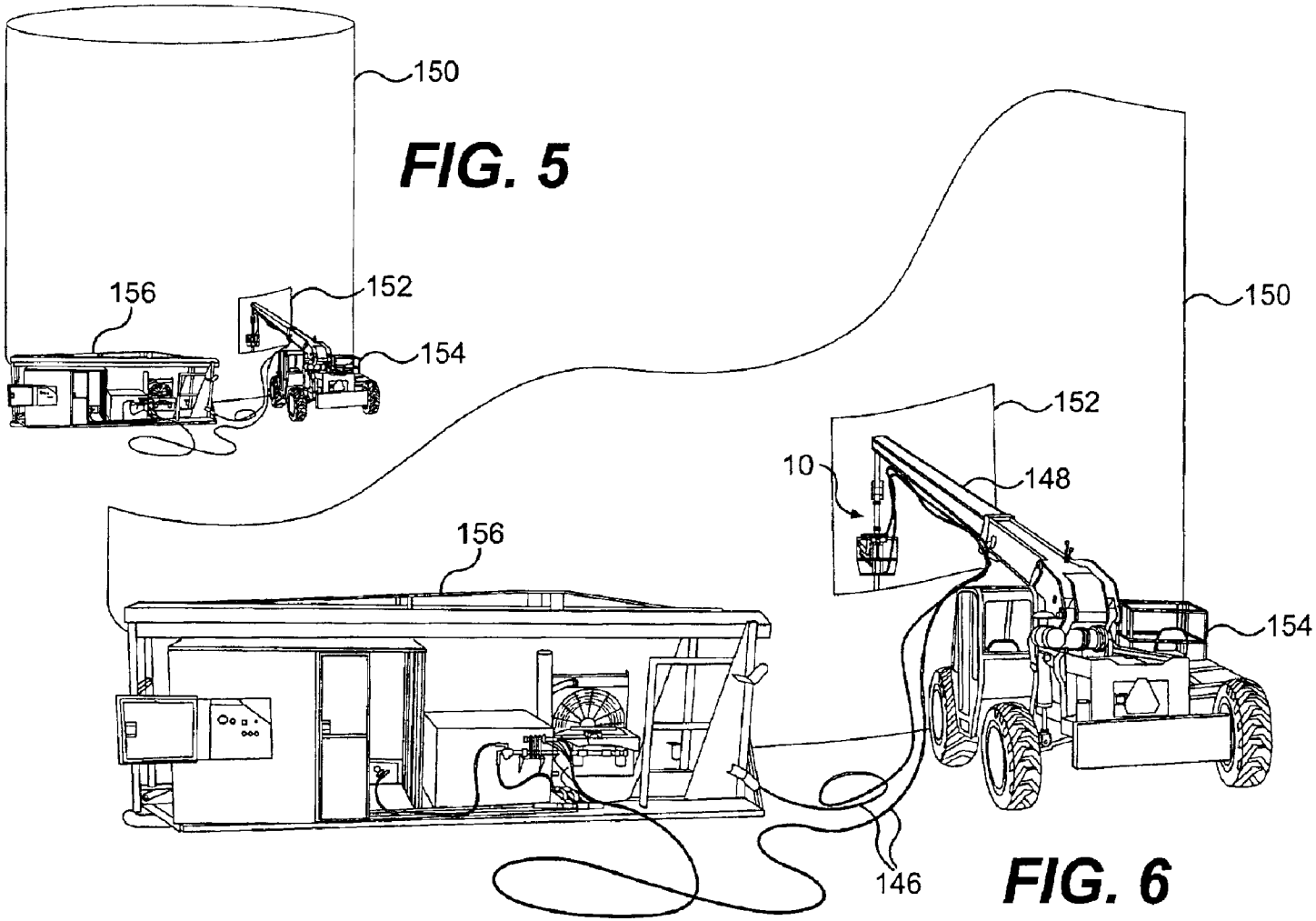
FIG. 5 illustrates an extendable bend forklift used to blend large tanks, consistent with the invention.
FIG. 6 is an enlarged view of a portion of FIG. 5.

In the illustrated embodiment, as shown in FIG. 1, the mixing unit 14 may include a central, integrated housing (or frame) 70 pivotably supported by the bearings 58 at the lower end of the bifurcated frame 40, and enclosing a pair of axially aligned, hydraulic motors 72 and 74 operated by hydraulic fluid supplied to and exhausted from the fitting pair 28 though hydraulic conduits (146 in FIG. 6) extending from the fitting pair 28 to a rotary flow divider 76 mounted to the housing 70. Opposingly operable thrust generators 78 and 80 may be mounted to opposite ends of the housing 70. Each of the thrust generators 78 and 80, in the illustrated embodiment, may be defined by propellers 82 and 84, driven by the respective motors 72 and 74. The propellers may be enclosed by open ended shrouds 86 and 88, supported by struts 90 that may be secured to the opposite ends of the housing 70. The propellers 82 and 84 may be pitched and rotated in a direction to direct a flow of liquid outwardly through the shrouds in opposite directions. Alternatively, shrouds may be omitted. In addition, the blades may be pitched in any direction capable of performing the desired level of mixing. Other conventional and known thrusting devices, including but not limited to pumps and jet propulsion devices may be used as the thrust generators 78 and 80. For example, propellers for watercraft may work well with the invention. An example of such a propeller includes a 14"×18" stainless steel chopper propeller.

The flow divider 76 may function to direct an equal volume of hydraulic fluid to each motor 72, 74. An equal volume of hydraulic fluid to each motor ensures that the thrust generated by each propeller 82, 84 is equal and opposite. This equal and opposite thrust, in turn, ensures that the reaction forces exerted on the housing 70 by the propellers 82 and 84 are equal and cancel each other. Accordingly, no substantial net force is exerted on the housing 70 or the frame 40 by simultaneous operation of the propellers 82 and 84.

A sled-like bearing foot 92 may be secured by brackets 94 to the underside of the housing 70 in the horizontal orientation thereof shown in FIG. 1. The bearing foot 92 may be spaced from the housing 70 and shrouds 86, 80 so that it may engage the floor of a tank in which the apparatus 10 is used and prevent damage to the thrust generators 78 and 80.

Figure 4:
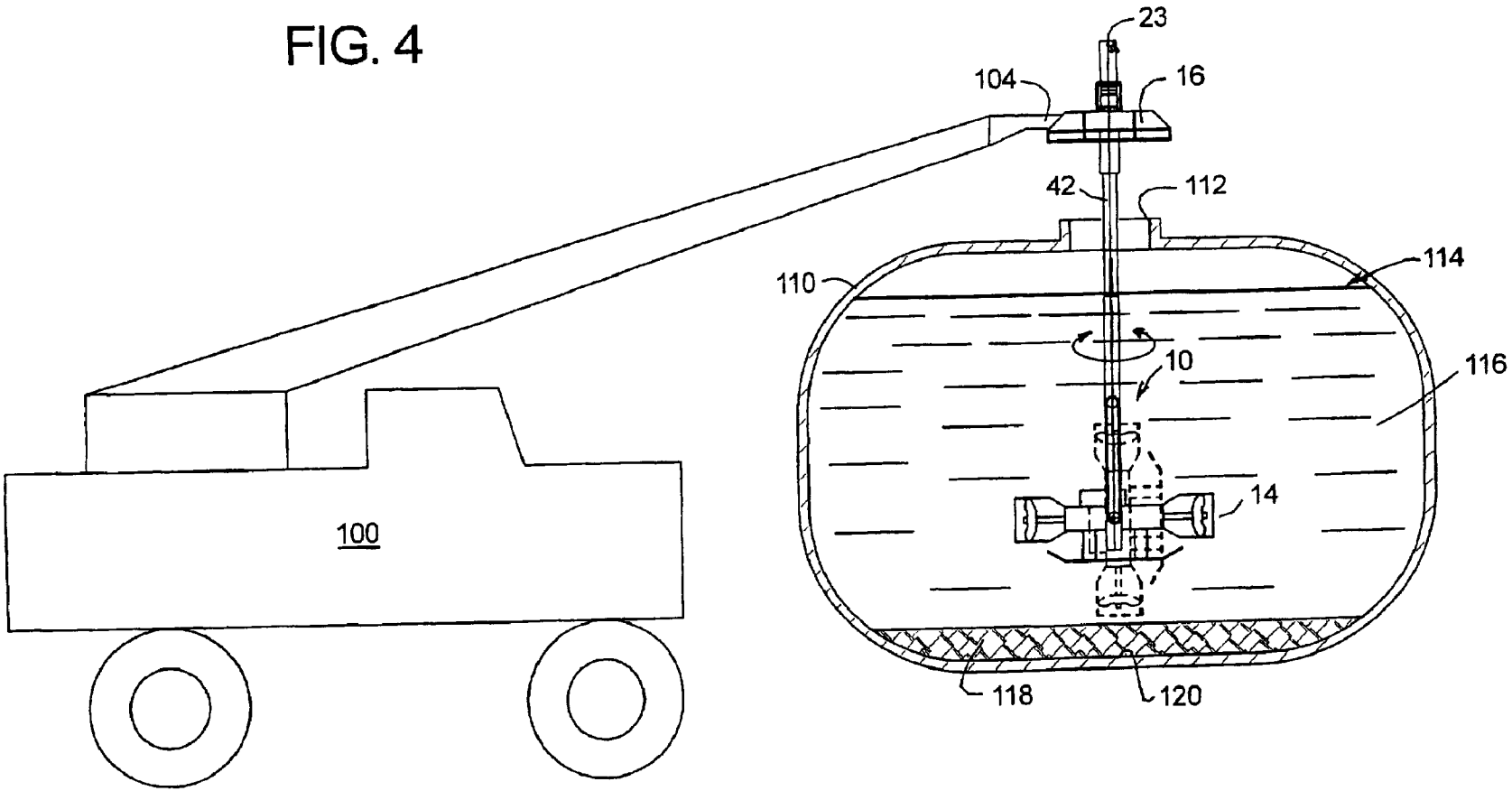
FIG. 4 is a largely schematic view showing the mixing apparatus lowered into a transport tank.

In use, the mixing apparatus 10 may be suspended from the handling pallet 16 engaged by a lifting device, such as a high reach fork lift truck 100, as depicted in FIG. 4 of the drawings. To facilitate this engagement, the handling pallet 16 may be formed with slot-like apertures 102, shown in FIG. 2, to receive the fork tines of the fork lift truck 100. In this manner, the handling pallet 16 may be retained against rotation under any reaction torque that may occur by operation of the motor 34 to rotate or oscillate the frame 40. Alternatively, the unit can also be adapted to be lowered into tall tanks from a crane. With such an arrangement, the unit may be strapped to the tank's roof.

The illustrated organization of the handling pallet 16 and motor driven rotation or oscillation of the frame 40 may enable the operator of the fork lift truck 100 to control all operating components of the apparatus 10, using a hydraulic control unit (not shown) connected to the fitting pairs 24, 26, and 28. Alternatively, the mixing apparatus could be suspended from a cable connected directly to the header 22. In this alternative, the handling pallet 16 could be replaced by a hand wheel fixed to the shaft 30 to facilitate manual rotational positioning of the frame 40, thus eliminating the need for the motor 34.

In accordance with the present invention, a method may be provided for mixing a substance having liquid and solid constituents contained in a tank having a floor, with a pivotal mixing unit having a pair of opposing thrust generators. Substances with which the invention may be used include calcium carbonate, other clay or clay-like materials, particulates, granules, powders, and other sedimentary substances. The invention may be used with hazardous and non-hazardous waste, substances, raw materials, and any other category of sedimentary substance. The invention may also be used to mix two liquids, where one liquid is lighter than the other and therefore the liquids tend to separate. The mixing may be performed on a substance that, after loading into the tank is separated into subcomponents, or, the mixing may be performed on two components that are separately loaded, and thereafter require mixing.

The method may include lowering the mixing unit into a tank with the thrust generators in a first position such that one of the thrust generators substantially faces the floor of the tank, clearing settled solid constituents from an area of the floor of the tank, moving the thrust generators to a second position generally parallel to the floor of the tank at the area cleared of the settled solid constituents, and mixing the liquid and solid constituents of the substance, including the settled solid constituents, with the thrust generators in the second position. In addition, since the thrust generators may be operable in varying positions, the pitch and angular orientation may be altered during mixing or at periodic intervals in order to accomplish either a more thorough and faster mixing, depending on the substances being mixed.

As shown FIG. 4, a tank 110, having a top access opening 112, is filled with a liquid/solids mixture generally designated by the reference number 114. The tank 110 may be any of many different types of tanks, including but not limited to rail tank cars, tank trucks, roll-off boxes, stationary tanks, any other mobile tanks and ISO containers. As depicted in FIG. 4, the mixture 114 is separated into an upper, primarily liquid component 116 and a solids component 118 settled on the floor 120 of the tank 110. This separation might occur over time, or the tank may be loaded with the components in substantially separate form. In order to unload the whole of the mixture 114 from the tank either by pumping it out through the opening 112, or by draining it through a drain conduit (not shown) in the floor 120, it is preferable to mix the sediment 118 with the liquid component 116, to cause a substantially homogenous mixture.

The mixing apparatus 10 may be operated to carry out the mixing method by lowering the mixing unit 14 down through the access opening 112 and into the tank 110 with the mixing unit 14 in the retracted position aligned with the elongated support structure 12 to fit through the reduced size of the access opening 112. If the access opening 112 large enough, however, the mixing unit 14 may be lowered into the tank 110 while it is in the extended position or in an intermediate position.

When the mixing unit 14 is submerged in the mixture 14, the mixing apparatus 10 may be used to clear the settled solid constituents 112 from an area of the floor 94. For example, as the mixing apparatus 10 is lowered into the tank 110 with the unit 14 in the retracted position R14 (FIG. 3), one of the thrust generators 78, 80 faces the floor 120. Accordingly, operating one or more of the thrust generators 78, 80 for sufficient period of time will clear the settled solid constituents 118 from an area of the floor 120 under the mixing apparatus 10. Thereafter, the mixing unit 14*k* may be adjusted to an inclined intermediate position V14 (FIG. 3) and the frame 40 rotated by operation of the motor 34 to enlarge the cleared area of the floor 120.

After an area of the floor 120 is cleared of the settled solid constituents 118, the mixing unit 14 may be moved to the extended position E14. With the mixing unit 14 in the extended position, the mixing apparatus 10 may be further lowered into the tank 110 such that the foot 92 engages the area of the floor 120 cleared of the settled solid constituents 118. When engaged with the floor 12 of the tank, the foot 92 may prevent the mixing unit 14 from moving toward the retracted position. However, the frame 40 may rotate around its longitudinal axis when the foot 92 engages the floor 120.

With the mixing unit 14 in the extended position, the thrust generators 78 and 80 may be used to mix the liquid and solid constituents of the mixture 114, including the settled solid constituents 118. The thrust generators 78 and 80 may produce sufficient thrust and flow to mix the mixture 114 in a short period of time. For example, each thrust generator 50 may produce flow of up to twenty-three thousand gallons per minute. This flow equates to forty-six thousand gallons per minute, the equivalent of rolling a tank car every thirty seconds.

The flow produced by the thrust generators 78 and 80 in the extended position may cause a thrust toward the side walls of the tank 110 near the floor 120 so that the solid constituents 118 of the mixture 114, including the settled solid constituents 118, may be undermined and thrust into the flow pattern developed by the thrust generators 78 and 80. The solid constituents may then return to the suction side of the thrust generators 78, 80 where they may be chopped and thrust out again and again until shortly, a homogenous mixture may be reached and may be ready to be off-loaded from the tank 110. The mixing apparatus 20 may be designed to handle slurries up to sixty percent solids and viscosities to ten thousand centipoises. The mixing apparatus may be permanently mounted in a tank or may be movable from tank to tank. Alternatively, the mixing apparatus may be mounted in a tanker or railcar.

Exemplary uses of the invention include the waste industry. For example, hazardous waste may be safely disposed of through incineration. To that end, hazardous waste may be used as fuel for cement kilns. Since the hazardous waste may be made up of solid and liquid constituents, the invention may include mixing the waste to form a substantially uniform mixture in the tank. A substantially uniform mixture ensures a substantially constant BTU valve across the tank resulting in substantially constant burning properties. And mixing helps ensure that minimal residue remains on the tank floor after unloading.

The invention may be employed with fixed tanks, tanks mounted on vehicles such as tanker trailers, or other movable containers such as roll-off boxes. For example, roll-off boxes can be used to contain K-waste from the refinery industry. Such K-waste may take the form of sludge derived from the refinery process and/or the tank cleaning process in refineries. A method of the invention may include adding a thin liquid, such as diesel fuel, to the sludge. A mixing unit may be used to blend the thin liquid with the sludge in order to put the mixture into a pumpable slurry form for disposal in an incinerator such as a cement kiln.

Another method of the invention may involve emptying large tanks (e.g., tank 150 in FIG. 5) having sludge layers on their bottoms. By way of example only, a tank of 10–200 feet in diameter containing a layer of sludge may be difficult to clean or empty. One or more holes 152 (for example, 8 feet by 8 feet) may be cut in the side of the tank 150 above the sedimentary layer. A liquid material such as, for example, diesel fuel or waste oil may be added to the tank. If the method involves disposal of a product to be burned, the added liquid is preferably burnable. A mixer 10 (such as the one previously described), suspended from the end of boom 148, may be inserted into the tank through the opening 152 in the tank wall and then activated by energizing hydraulic fluid power unit 156. The boom 148 may be part of an extendable bend forklift 154, which may have a reach of up to 70 feet or more. Through entering the tank at various angles and also extending the forklift to various lengths, the tank may be blended. Other insertion structures or methods may alternatively be used. The tank contents may then be pumped off or vacuumed into an agitator tanker trailer (such as the one described in U.S. Pat. No. 6,333,446, incorporated herein by reference). The contents may thereby be transported to a cement kiln or other incinerator for disposal.

In one example, one foot of diesel fuel was added to a 70 foot diameter tank containing 8 feet of sludge on the bottom. Using the structure described herein, it was possible to blend the tank in 48 hours, emptying it to 3 inches of sludge without any personnel having to enter the tank. Typical units may run at 200–300 horsepower, and larger units may extend to 600 horsepower or greater. While the mixing unit described herein may be used in connection with methods of the invention, in its broadest sense the various mixing methods of the invention are not limited to any particular structure.

It will be apparent to those skilled in the art that various modifications and variations can be made to the invention without departing from the scope or spirit of the invention. Other embodiments of the invention will be apparent to those skilled in the art from consideration of the specification and practice of the invention disclosed herein.

What is claimed is:

1. A method for mixing a substance including liquid and solid constituents, the substance being contained in a tank having a floor, at least a portion of the solid constituents being settled on the floor of the tank, the method comprising:

providing a mixing apparatus, the mixing apparatus including a frame, and a pair of opposing thrust generators pivotably mounted to the frame, the frame including an opening for receiving at least one of the thrust generators therein;

lowering at least a portion of the mixing apparatus into the tank with the thrust generators in a first position wherein one of the pair of thrust generators is oriented generally within the opening and above the other of the pair of thrust generators;

after said step of lowering, moving the pair of thrust generators to a second position spaced from the first position;

with the thrust generators in the second position; mixing the liquid and solid constituents of the substance, including the settled solid constituents;

moving the pair of thrust generators from the second position to the first position; and removing the mixing apparatus from the tank when the pair of thrust generators are substantially in the first position.

2. The method of claim 1, further comprising rotating the frame around a longitudinal axis thereof and thereby rotating the thrust generators around the longitudinal axis of the frame, such that in the first position the pair of thrust generators are in a generally vertical orientation with respect to each other, and in the second position the pair of thrust generators are in a generally lateral orientation with respect to each other.

3. The method of claim 1, wherein the tank has a reduced size opening and wherein at least a portion of the mixing apparatus is lowered into the tank through the reduced size opening with the thrust generators in the first position.

4. The method of claim 1 where at least one of the liquid and solid constituents includes a waste product.

5. The method of claim 1, wherein the solid constituents include calcium carbonate.

6. The method of claim 1 wherein the solid constituents include at least one of granules, powders, chips, clays, and pebbles.

7. The method of claim 1, further comprising cutting at least one hole in the tank above a top surface of the substance, and wherein said lowering step includes inserting at least a portion of the mixing apparatus into the hole.

8. The method of claim 1, further including adding at least a portion of the liquid constituents to the tank in a quantity sufficient to enable the solid constituents to form a blended mixture capable of flowing out of the tank.

9. The method of claim 8, further comprising off-loading the blended mixture to an agitator tanker trailer for transportation to a disposal site.

10. The method of claim 8, wherein the added at least said portion of the liquid constituents is burnable.

11. The method of claim 1, wherein the substance is a burnable material.

12. The method of claim 1, wherein the substance is K-waste.

13. The method of claim 12, wherein the K-waste is a product of a refinery process.

14. The method of claim 1, wherein said lowering step includes inserting the mixing apparatus into a tank using a forklift.

15. A method for mixing a substance including liquid and solid constituents, the substance being contained in a tank having a floor, at least a portion of the solid constituents being settled on the floor of the tank, the method comprising:

providing a mixing apparatus, the mixing apparatus including a frame, a pair of opposing thrust generators pivotably mounted to the frame and a floor-contacting members;

lowering at least a portion of the mixing apparatus into the tank with the thrust generators in a first position, wherein one of the pair of thrust generators is oriented generally above the other of the pair of thrust generators;

after said step of lowering, moving the pair of thrust generators to a second position spaced from the first position;

with the thrust generators in the second position and the floor contacting member engaging the floor, mixing the liquid and solid constituents of the substance, including the settled solid constituents;

moving the pair of thrust generators from the second position to the first position; and removing the mixing apparatus from the tank when the pair of thrust generators are substantially in the first position.

16. The method of claim 15, wherein the floor-contacting member prevents the thrust generators from moving toward the first position when the floor-contacting member engages the floor.

17. A method for mixing a substance including liquid and solid constituents, the substance being contained in a tank having a floor, at least a portion of the solid constituents being settled on the floor of the tank, the method comprising:

providing a mixing apparatus, the mixing apparatus including a first frame portion pivotably mounted to a second frame portion, and a pair of opposing thrust generators pivotably mounted to the first frame portion;

lowering at least a portion of the mixing apparatus into the tank with the thrust generators in a first position, wherein one of the pair of thrust generators is oriented generally above the other of the pair of thrust generators;

after said step of lowering, moving the pair of thrust generators to a second position spaced from the first position;

with the thrust generators in the second position and the first portion of the frame maintaining the pair of thrust generators at a fixed distance apart from each other, mixing the liquid and solid constituents of the substance, including the settled solid constituents;

moving the pair of thrust generators from the second position to the first position; and removing the mixing apparatus from the tank when the pair of thrust generators are substantially in the first position.

18. The method of claim 17, wherein mixing includes powering the pair of thrust generators such that a first one of the pair of thrust generators exerts a first force on one end of the first frame portion, and a second one of the pair of thrust generators exerts a second force on an opposing second end of the first frame portion, the second force being substantially equal and opposite to the first force.

19. The method of claim 17, wherein said step of moving the pair of thrust generators from the first position to the second position is accomplished by pivoting the first frame portion relative to the second frame portion, and wherein, the method further comprising before pivoting, a step of energizing at least one of said pair of thrust generators while the at least one of said pair of thrust generators faces the floor of the tank.

* * * * *

UNITED STATES PATENT AND TRADEMARK OFFICE

CERTIFICATE OF CORRECTION

PATENT NO. : 6,964,511 B2
APPLICATION NO. : 10/302871
DATED : November 15, 2005
INVENTOR(S) : Robert M. Rumph It is certified that error appears in the above-identified patent and that said Letters Patent is hereby corrected as shown below:

Column 7,
Line 50, “position; mixing” should read -- position, mixing --.

Column 8,
Line 38, “members;” should read -- member; --.

Signed and Sealed this

Twenty-seventh Day of June, 2006

JON W. DUDAS
*Director of the United States Patent and Trademark Office*